US006458247B1

(12) United States Patent
Uuttana

(10) Patent No.: US 6,458,247 B1
(45) Date of Patent: Oct. 1, 2002

(54) LOADING ARRANGEMENT IN A PAPER MACHINE DOCTOR

(75) Inventor: Kyösti Uuttana, Karlstad (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/534,666

(22) Filed: Mar. 24, 2000

(30) Foreign Application Priority Data

Apr. 15, 1999 (FI) ..... 990837

(51) Int. Cl.[7] ..... D21G 3/00
(52) U.S. Cl. ..... 162/281; 15/256.51; 100/174
(58) Field of Search ..... 162/281, 280; 15/256.51, 256.5, 256.53; 100/174

(56) References Cited

U.S. PATENT DOCUMENTS

| | | | | |
|---|---|---|---|---|
| 3,085,275 A | | 4/1963 | Allison | |
| 4,769,111 A | * | 9/1988 | Nevalainen et al. | 162/352 |
| 4,988,408 A | * | 1/1991 | Evalahti | 162/352 |
| 5,279,710 A | | 1/1994 | Aikawa | 162/281 |
| 5,980,692 A | * | 11/1999 | Goodnow et al. | 162/281 |
| 6,120,649 A | * | 9/2000 | Eriksson | 162/281 |
| 6,159,289 A | * | 12/2000 | Kurtz | 118/119 |

FOREIGN PATENT DOCUMENTS

| | | | |
|---|---|---|---|
| DE | 1635384 A | | 3/1971 |
| EP | 0294992 A | | 12/1988 |
| EP | 0906788 A | | 4/1999 |
| GB | 1419616 A | | 12/1975 |
| WO | 97/25475 | * | 7/1997 |

* cited by examiner

*Primary Examiner*—Karen M. Hastings
(74) *Attorney, Agent, or Firm*—Fildes & Outland, P.C.

(57) ABSTRACT

A loading arrangement in a paper machine doctor includes a blade carrier, a blade holder, and loading devices to turn the blade holder in relation to the blade carrier and thus to press the doctor blade against the surface to be doctored. The loading devices include at least one operating device including longitudinally arranged loading components and a pressure medium connection extending to each of the loading components to make the profile of the doctor blade conform to the surface to be doctored.

6 Claims, 3 Drawing Sheets

LOADING ARRANGEMENT IN A PAPER MACHINE DOCTOR

FIELD OF THE INVENTION

This invention relates to a loading arrangement in a paper machine doctor, in which the doctor includes a blade carrier and a blade holder fitted to it rotatably by means of an articulated joint. Loading devices operated by a pressure medium are fitted between the blade carrier and the blade holder, to turn the blade holder in relation to the blade carrier and thus to press the doctor against the surface to be doctored.

BACKGROUND OF THE INVENTION

Generally, the blade holder of a doctor is made in several parts or to be otherwise flexible, so that the doctor blade, which is as such flexible, will lie against the surface to be doctored. In this case, however, the contact force on the actual surface of a doctor blade pressed by means of conventional loading devices varies at different points. This variation appears as a poor doctoring result and uneven wear in the doctor blade.

U.S. Pat. No. 5,279,710 discloses a paper machine doctor, in the blade holder of which there are fine-adjustment screws, in addition to the doctor blade attachment screws. The tightness of the fine-adjustment screws acts on the doctor blade and the screws can be used to try to force the doctor blade to conform to the shape of the surface being doctored. The solution disclosed is, however, complicated and only a small shaping effect can be achieved on the doctor blade with the fine-adjustment screws. In addition, the blade settings cannot be changed during operation, and vibration can cause the setting of the fine-adjustment screws to alter.

SUMMARY OF THE INVENTION

The present invention provides new kind of loading arrangement for a paper machine doctor, by means of which the shape of the doctor blade and the force it directs to the surface being doctored can be adjusted in zones during operation.

More specifically, the present invention provides a loading arrangement in a paper machine doctor, in which the doctor includes a blade carrier and a blade holder fitted to it rotatably by means of an articulated joint. Loading devices operated by a pressure medium are fitted between the blade carrier and the blade holder to turn the blade holder in relation to the blade carrier and thus to press the doctor blade against the surface to be doctored. The loading devices include at least one operating device on the loading or the return side, which operating device comprises two or more loading components set one after the other in the longitudinal direction of the doctor. An independent pressure medium connection extends to the loading components, to make the profile of the doctor blade conform to the surface to be doctored, over the length of the doctor.

In one embodiment of the invention there are 3–21 loading components in the operating device. Preferably, there are 5–9 loading components in the operating device.

The loading components are fitted to touch each other, so that they form a loading hose extending over the length of the doctor. There are operating devices on both the return side and loading side of the doctor, the constructions of which essentially correspond to each other.

Each pressure medium connection is arranged to each loading component through its outer surface. Each pressure medium connection may be formed from a flexible tube, which extends from the loading component to either end of the doctor.

The pressure medium connection is arranged by means of tubes fitted inside the loading components, and which extend through the end walls of the loading components. The tubes are arranged inside a stiff metal pipe, which is fitted tightly to the end walls of the loading components.

Each pressure medium connection may be formed from a common feed line and have control valves connected to it. The feed lines may be arranged in the axle forming part of the jointing, or in connection with it.

The loading arrangement according to the invention can be used to load the doctor blade at certain intervals with a desired force. This improves the doctoring result throughout. The loading arrangement according to the invention can also be used to even out the possible uneven wear of the doctor blade. In addition, as the contact force can be adjusted in zones, a good doctoring result can be ensured by increasing the contact force, for example, in the web feeding area. In a corresponding way, it is possible to adjust the roughening effect of the doctor blade on the roll surface.

These and other features and advantages of the invention will be more fully understood from the following detailed description of the invention taken together with the accompanying drawings.

DETAILED DESCRIPTION OF THE INVENTION

Figure 1:
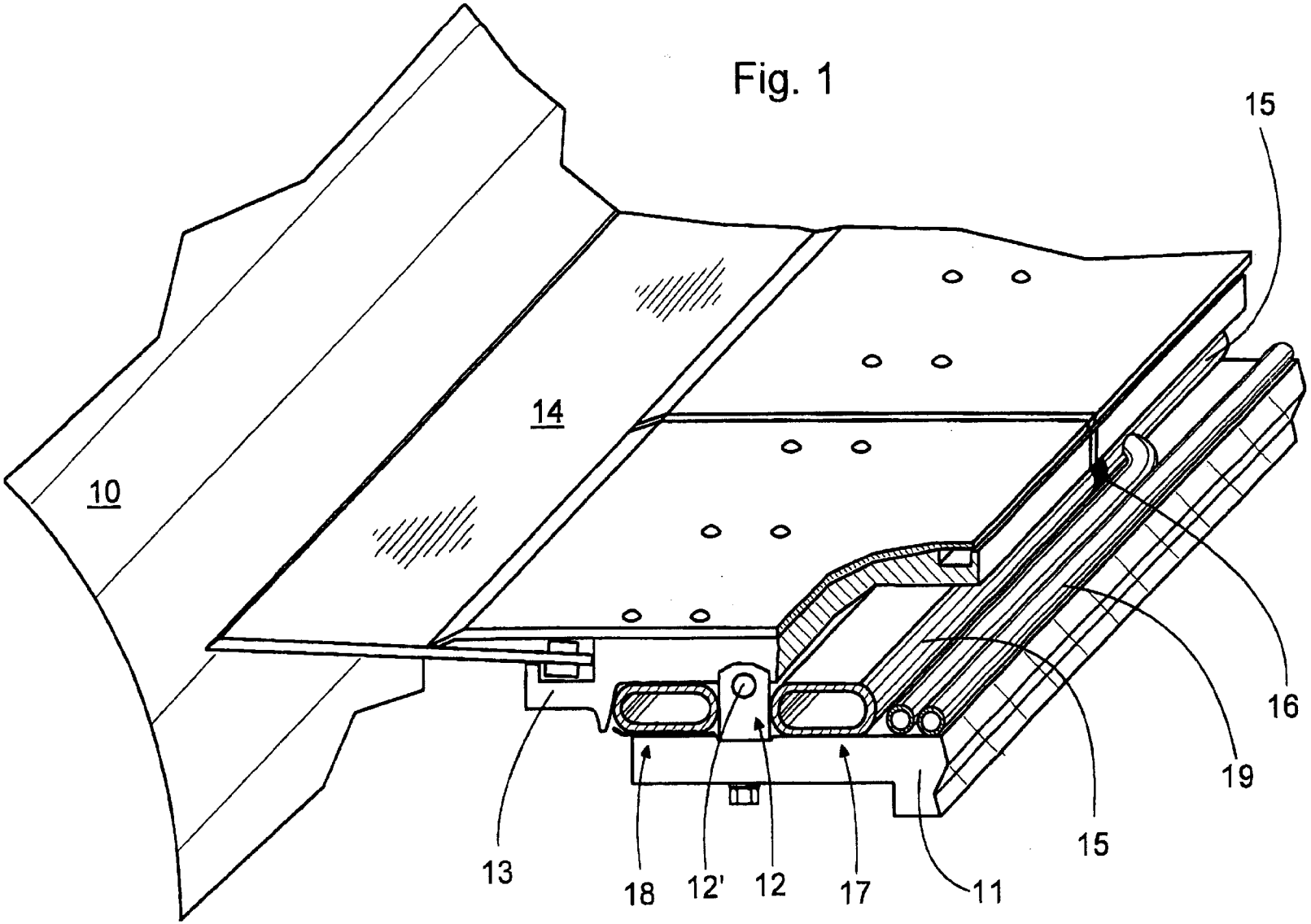
FIG. 1 is an axonometric view of a partial cross-section of a doctor according to the invention, seen from the end.

Referring now to the drawings in detail, FIG. 1 shows a doctor, the main principles of which are conventional, fitted in connection with a roll 10. As only part of the blade carrier 11 of the doctor is shown, the support of the doctor cannot be seen. Blade holder 13 is attached to blade carrier 11 by means of an articulated joint 12, in such a way that it can be turned. Blade holder 13 is turned in relation to blade carrier 11 by means of loading devices operated by a pressure medium, which in this embodiment are loading hoses 17 and 18. Though it is preferable to use compressed air as the pressure medium, other mediums are possible. The actual doctor blade 14, which can be changed simply while the doctor remains in place, is installed in blade holder 13.

According to the invention, the loading devices include at least e operating device on the loading or the return side. Such an operating device consists two or more loading components 15, set one after the other in the longitudinal direction of the doctor. In FIG. 1, the joints between the sequential loading components 15 are shown with the reference number 16. In addition, an independent pressure medium connection extends to each loading component 15. Thus, the profile of doctor blade 14 can conform over the length of the doctor to the surface being doctored. In the same way, the contact force of doctor blade 14 to the surface being doctored can be adjusted in zones over the length of the doctor, by arranging a different pressure in the loading components 15.

In order to make a loading arrangement according to the invention possible, blade holder 13 must be sufficiently flexible for the effect of the loading components to be transferred to doctor blade 14. Alternatively, blade holder 13 can comprise several pieces, which are jointed to blade carrier 11 independently of each other. Preferably, the joints 16 between the loading components 15 are according to FIG. 1 at blade holder 13, to create clear boundaries between the zones of doctor blade 14.

Operating devices, the constructions of which essentially correspond to each other, can be arranged on both the return side and the loading side of the doctor. Thus, the suitable adjustment of the loading pressure of loading hose 17 and of the counter-pressure of return hose 18, will achieve precisely the desired profile of doctor blade 14 and the contact force, over the length of the doctor. The range of possible adjustments can be increased by setting the loading components 15 of the loading and return hoses 17 and 18 at different points in the longitudinal direction of doctor blade 14. The precision of the adjustment is also affected by the size selected for the loading components.

Figure 2:
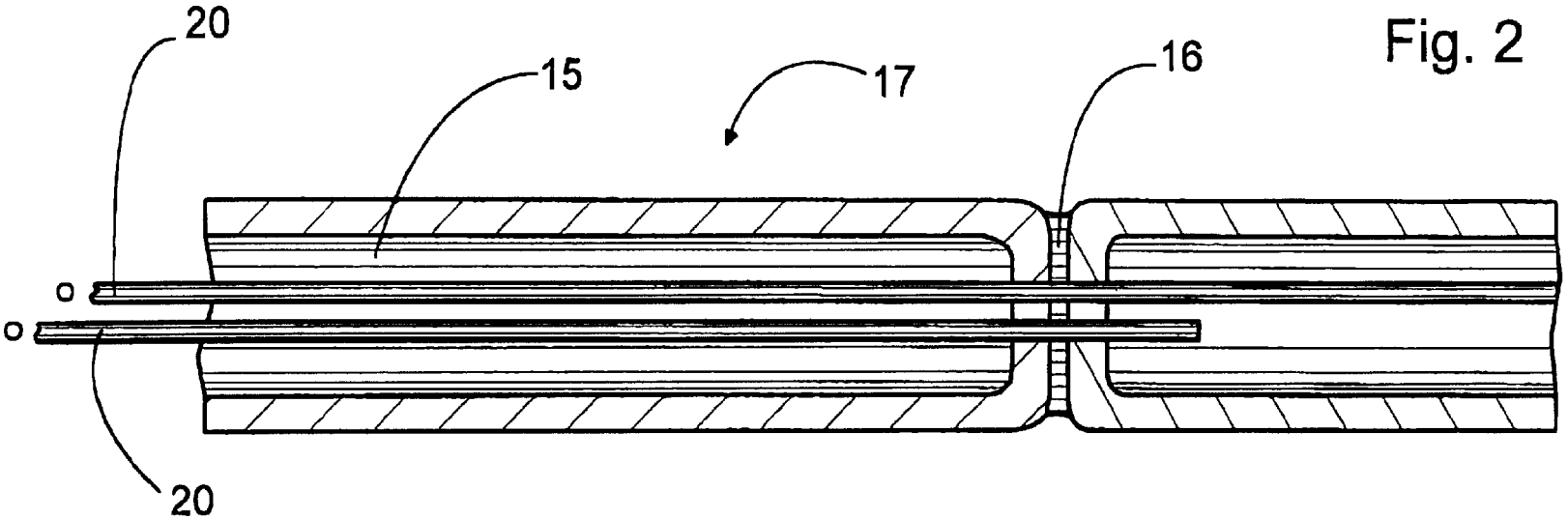
FIG. 2 is a sectional view of another embodiment of a doctor loading device according to the invention.
Figure 3:
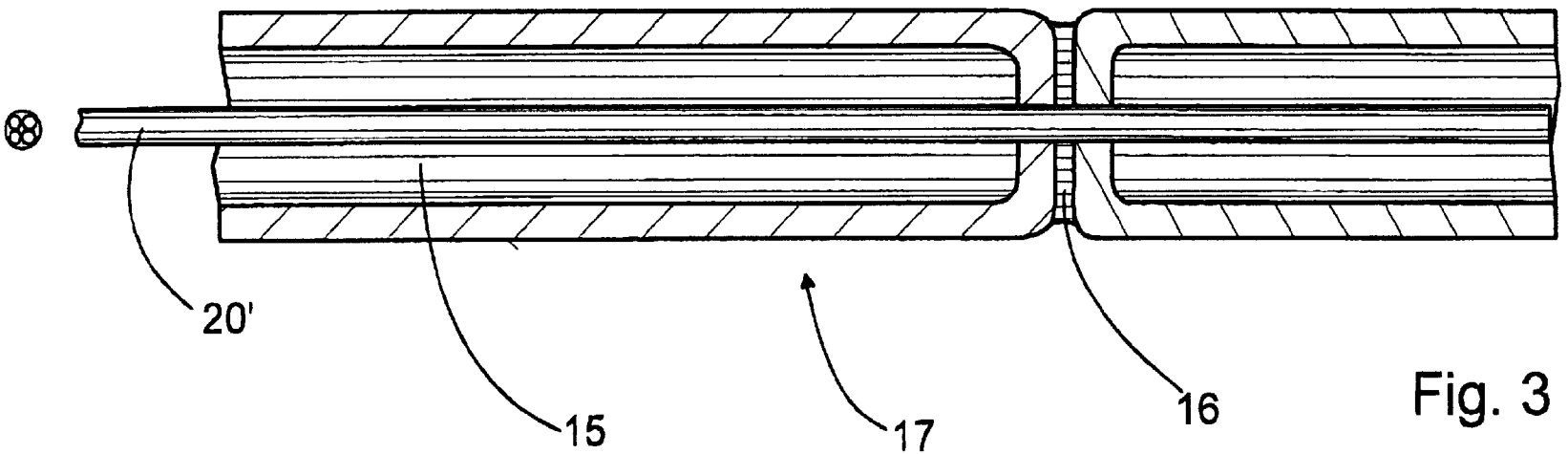
FIG. 3 is a sectional view of a variation of the embodiment of FIG. 2.

According to the invention, there are 3–21, preferably 5–9 loading components. Though an increase in the number of loading components will increase the adjustment precision, it will then become more difficult to arrange the pressure medium connections. On the other hand, the use of even a few loading components only in the loading hose, will bring an obvious improvement in the doctoring result. At the same time, the contact force can be adjusted as desired with sufficient precision. In addition, the loading components need not necessarily be the same size. Loading components of different sizes can be used to concentrate the adjustment zones at the end of the doctor or at the center of it or at both. The loading hose can also have its own loading component fitted to it, for example, in the web-feeding area. In practice, the loading components are fitted so that they touch each other to form a loading hose extending over the length of the doctor. The outward appearance of a loading hose of this kind differs from that of a conventional loading hose mainly only at the joints. FIGS. 2 and 3 also show one joint 16. The use of a unified loading hose will ensure that it remains in place between the blade holder and the blade carrier. It is also easier to form pressure medium connections to a unified loading hose than to separate loading components.

The pressure medium connections to the loading components can be arranged in several different ways. FIGS. 1–3 show three ways. According to FIG. 1, each pressure medium connection is arranged in each loading component 15 from its outer surface. In this case, each pressure medium connection is formed by a flexible tube 19. Tube 19 extends from loading component 15 to either end of the doctor. Pressure is fed to the loading components 15 preferably from both ends of the doctor, when the longest tubes required will be less than half of the total length of the loading hose. The features presented in the disclosure also suit the return hoses, unless otherwise stated.

Another way is to arrange the pressure medium connections in the inside of the loading components. This can be easily done using tubes 20, which extend through the joints 16 of the loading components 15, as shown in FIG. 2. Each tube 20 is sealed separately at joint 16. In this case, however, numerous points requiring sealing are created. Alternatively, the tubes can be arranged inside a single larger metal pipe 20', which metal pipe 20' is fitted tightly to the end walls of the loading components 15, i.e. to joint 16. The embodiment of FIG. 3 shows this alternative.

Figure 4:
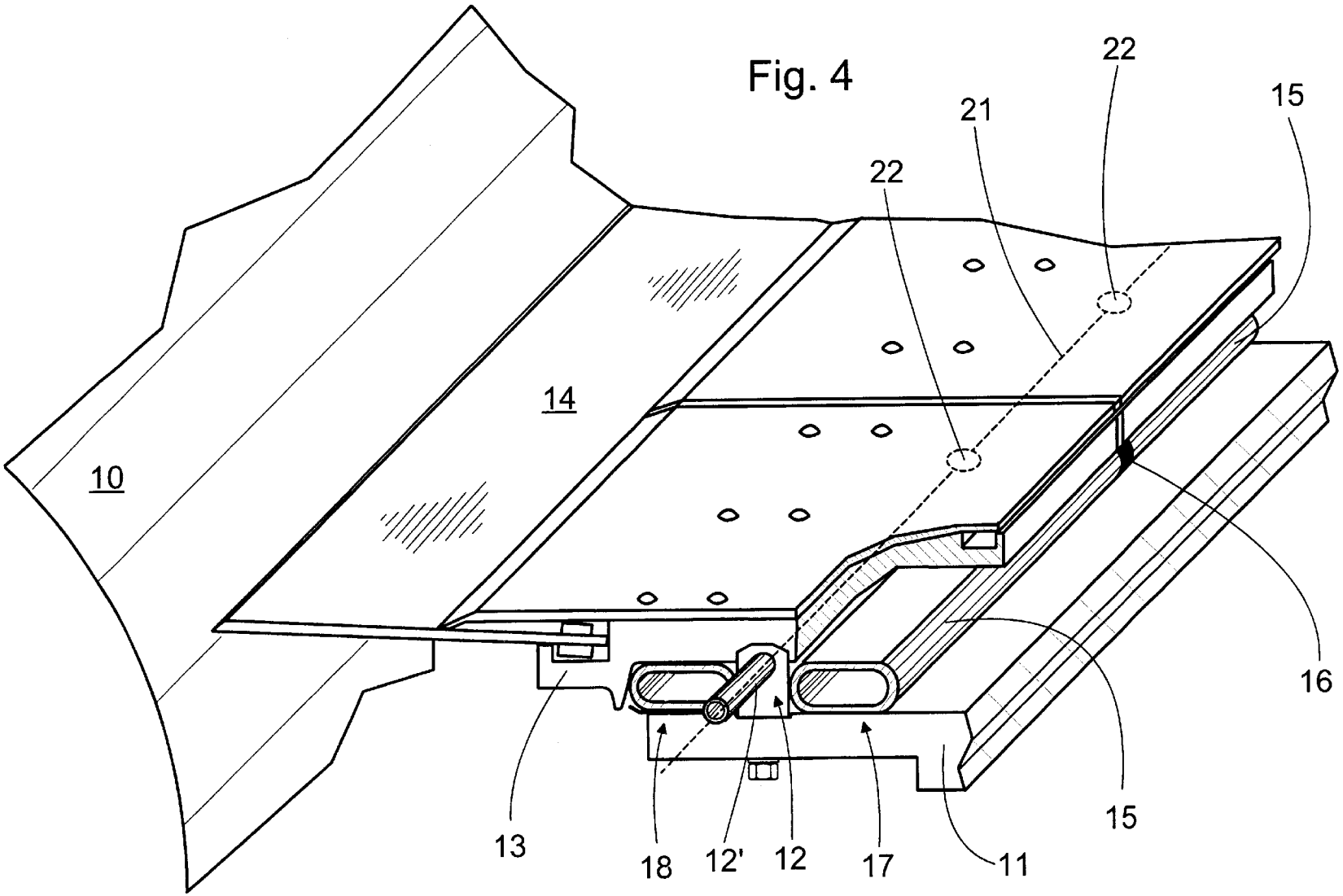
FIG. 4 is an axonometric view of a partial cross-section of a doctor according to a second embodiment of the invention.

In the solutions described above, the control valves of the loading components are situated far from the doctor. Alternatively, each pressure medium connection can be formed from a common feed line and control valves connected to it. In that case, the doctor preferably has only a single feed line and a cable for the electric valves. One way is to arrange the feed line in the axles 12' forming part of the articulated joint 12, or in connection with it. In FIG. 4 each pressure medium connection is formed from a common feed line 21 and control valves 22 connected to the common feed line 21, which is arranged in the axle 12' forming part of the joint 12, or in connection with the axle 12' .

Pressure can be fed in quite a known manner to the loading components at the ends of both the loading and return hoses. Pressure is then fed to the inner loading components in one of the ways according to the invention. Different ways can be applied simultaneously in a single doctor. In practice, all of the ways described are advantageous, though differences exist between them. Though internal tubes do not hang detrimentally, they are more difficult to maintain that external tubes. In addition, in cases of damage, all the internal tubes tend to be damaged simultaneously. Correspondingly, simultaneous damage is rare in external hoses and damaged sections can be easily located and repaired.

The loading arrangement according to the invention can also be used, not only to adjust the profile of the doctor blade, but also to adjust the force of the contact with the surface being doctored. Unlike the state of the art, the doctor can be adjusted while it is operating. The properties of the loading system can be exploited, for example, to compensate for wear in the doctor blade. In normal doctor, the doctor blade wears most in the center, so that wear is least at the edges. In the same way, there is unevenness in the loading profile of the doctor blade. By increasing the pressure on the edge zones, the contact force at these points is increased. In that case, the doctor blade wears most at the edges, so that the whole doctor blade wears evenly and the contact force is even. A local increase in contact force can also be used in the web feeding area, to ensure that web feeding succeeds. In addition, the surface being doctored is usually the surface of a roll, which practically does not wear. However, the doctor blade affects the surface roughness of the roll, so that the contact force can be adjusted to affect the surface roughness locally. Thus, the loading arrangement can be used to achieve a good doctoring result, even surface roughness of the roll, and even wear in the blade.

Although the invention has been described by reference to specific embodiments, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A loading arrangement in a paper machine doctor, in which the doctor includes a blade carrier and a blade holder fitted to it rotatably by means of an articulated joint, and in which loading devices operated by a pressure medium and formed of loading hoses, are fitted between the blade carrier and the blade holder to turn the blade holder in relation to the blade carrier and thus to press the doctor blade against the surface to be doctored, and the loading devices include at least one operating device on the back or the front side of the articulated joint, which operating device comprises two or more loading components set one after the other in the longitudinal direction of the doctor, to each of which an independent pressure medium connection extends, to make the profile of the doctor blade conform to the surface to be doctored, over the length of the doctor characterized in that each pressure medium connection is formed from a common feed line and control valves connected to said common feed line, which is arranged in the axle forming part of the joint, or in connection with the axle.

2. A loading arrangement according to claim 1, characterized in that there are 3–21 loading components in the operating device.

3. A loading arrangement according to claim 2, characterized in that the loading components are fitted to touch each other, so that they form a loading hose extending over the length of the doctor.

4. A loading arrangement according to claim 3, characterized in that said at least one operating device comprises two operating devices, one on the back and one on the front side of the articulated joint, the constructions of which essentially correspond to each other.

5. A loading arrangement according to claim 4, characterized in that each pressure medium connection is arranged to each loading component through its outer surface.

6. A loading arrangement in a paper machine doctor, in which the doctor includes a blade carrier and a blade holder fitted to it rotatably by means of an articulated joint, and in which loading devices operated by a pressure medium and formed of loading hoses, are fitted between the blade carrier and the blade holder to turn the blade holder in relation to the blade carrier and thus to press the doctor blade against the surface to be doctored, characterized in that the loading devices include at least one operating device on the back or the front side of the articulated joint, which operating device comprises two or more loading components set one after the other in the longitudinal direction of the doctor, to each of which an independent pressure medium connection extends, to make the profile of the doctor blade conform to the surface to be doctored, over the length of the doctor, said pressure medium connection being arranged by means of tubes fitted inside the loading components, and which extend through the end walls of the loading components, said tubes being arranged inside a stiff metal pipe, which metal pipe is fitted tightly to the end walls of the loading components.

* * * * *